US009797671B2

(12) United States Patent
Gorcynski et al.

(10) Patent No.: US 9,797,671 B2
(45) Date of Patent: Oct. 24, 2017

(54) INTERNAL FIRING PIN SAFETY MECHANISM FOR 1911 PISTOL

(71) Applicants: Raymond Anthony Gorcynski, Laguna Beach, CA (US); Yi Huei Jen, Santa Ana, CA (US)

(72) Inventors: Raymond Anthony Gorcynski, Laguna Beach, CA (US); Yi Huei Jen, Santa Ana, CA (US)

( * ) Notice: Subject to any disclaimer, the term of this patent is extended or adjusted under 35 U.S.C. 154(b) by 0 days.

(21) Appl. No.: 14/965,707

(22) Filed: Dec. 10, 2015

(65) Prior Publication Data

US 2017/0167813 A1 Jun. 15, 2017

(51) Int. Cl.
*F41A 17/24* (2006.01)
*F41C 3/00* (2006.01)
*F41A 17/20* (2006.01)

(52) U.S. Cl.
CPC ..... *F41A 17/24* (2013.01); *F41C 3/00* (2013.01); *F41A 17/20* (2013.01)

(58) Field of Classification Search
CPC ..... F41A 17/24; F41C 3/00
USPC ..... 42/70.08, 6, 7, 66, 70.01, 70.11
See application file for complete search history.

(56) References Cited

U.S. PATENT DOCUMENTS 1,113,239 A * 10/1914 Navarro ..... F41A 19/31 89/149
2,182,693 A * 12/1939 Harton ..... F41A 17/20 42/70.01
2,335,669 A * 11/1943 Hanson ..... F41A 17/20 42/70.06
2,365,440 A * 12/1944 Seitz ..... F41A 17/20 42/69.02
2,405,798 A * 8/1946 Seitz ..... F41A 17/20 42/69.02
2,436,267 A * 2/1948 Rogers ..... F41A 17/20 42/70.03
2,679,706 A * 6/1954 Windle ..... F41A 17/20 42/70.08
5,036,612 A * 8/1991 Jennings ..... F41A 17/24 42/70.08
6,374,526 B1 * 4/2002 Mochak ..... F41A 17/24 42/70.08
6,941,692 B1 * 9/2005 Krinke ..... F41A 17/02 42/70.08

FOREIGN PATENT DOCUMENTS

DE 102006005117 A1 * 8/2007 ..... F41A 17/02
DE 102006005117 A1 * 8/2007 ..... F41A 17/02

* cited by examiner

*Primary Examiner* — John Cooper
(74) *Attorney, Agent, or Firm* — Che-Yang Chen; Law Offices of Scott Warmuth

(57) ABSTRACT

An internal firing pin safety mechanism for a pistol, for example an M1911 80-Series pistol, which is activated by the beaver tail, rather than the trigger. The mechanism's constituents are comprised of a beaver tail, which engages a beaver tail lever when gripped, which in turn engages a plunger lever. The plunger lever then pushes up a firing pin block that has a concave opening, which allows the firing pin to pass through and strike the pistol's chamber.

2 Claims, 3 Drawing Sheets

INTERNAL FIRING PIN SAFETY MECHANISM FOR 1911 PISTOL

BACKGROUND

The field of the present invention relates to the safety mechanisms of a firearm. Specifically, the invention relates to the internal safety mechanisms of firearms such as the M1911 80-Series hand firearm, which are designed for inhibiting the firearm's firing pin in the case where the weapon's hammer is in the cocked position, and the firearm is given a sudden impulse that may otherwise set off the hammer and accidentally fire a chambered round.

Since its initial development in the 1970's, the Colt M1911 70-Series pistol has come with two different safety mechanisms. The first safety mechanism is the standard external manual latch-safety, which prevents the trigger from being engaged when the latch is in the "on" position. The second mechanism is engaged through the grip safety, particularly the pistol's beaver tail. When the pistol is not being held, the beaver tail is not pushed in, which provides a means of blocking the trigger. However, when the pistol is gripped in the natural firing position, the safety is disengaged, and the trigger is allowed to be pulled and a round fired. A problem did result with the pistol despite these two features: if the hammer of the pistol was cocked back and a round was chambered, and the pistol was dropped or given some sort of impulse, then there was a chance that the hammer would still strike the safety pin, setting off the round.

In response, about a decade after the 70-Series was released, the M1911 80-Series was developed. This version had the same safety mechanisms as the 70-Series, with one addition: an internal firing pin safety. This remedied the problem of the 70-Series by providing a mechanism in which a safety pin (metal cylinder) would block the firing pin from striking the chamber. This will not allow any type of firing to occur until the trigger is actually pulled, which activates various lever mechanisms that lift the safety pin upwards, revealing a clearing through which the firing pin can travel and successfully set off the round.

Although this design solved one problem, it did not come without its cost. One problem this new safety mechanism has created stems from the fact that at least three different parts (often made of metal) had to be introduced into the firearm body. Since pulling the trigger initiates the movement of the parts, the user has to exert more force on the trigger in order to overcome both the inertia and rotational moment of inertia that each individual piece of the safety mechanism possesses. In addition, each piece dissipates more energy given by the trigger through frictional rubbing, which means the user must exert an even greater amount of force on the trigger in order to fire a round.

Because the user now needs to exert more force on the trigger, the result is a loss of firing accuracy. It is therefore apparent that there exists a need for an internal safety mechanism that prevents the firearm from firing if it is given a sudden impulse, while at the same time giving the user the luxury of not having to exert too much force on the trigger, ultimately resulting in a more accurate shot.

SUMMARY OF INVENTION

The present invention aims at a safety mechanism for the M1911 firearm which contains an internal firing pin safety apparatus. More specifically, the invention aims at an internal firing pin safety mechanism that is activated by the beaver tail, rather than the trigger. More specifically, the invention aims at an internal firing pin safety mechanism wherein, once the beaver tail is engaged, it activates a beaver tail lever, which in turn activates a plunger lever, which in turn engages the firing pin block, thereby allowing the firing pin to strike the chamber and fire off a chambered round.

DETAILED DESCRIPTION OF DRAWINGS

Figure 1:
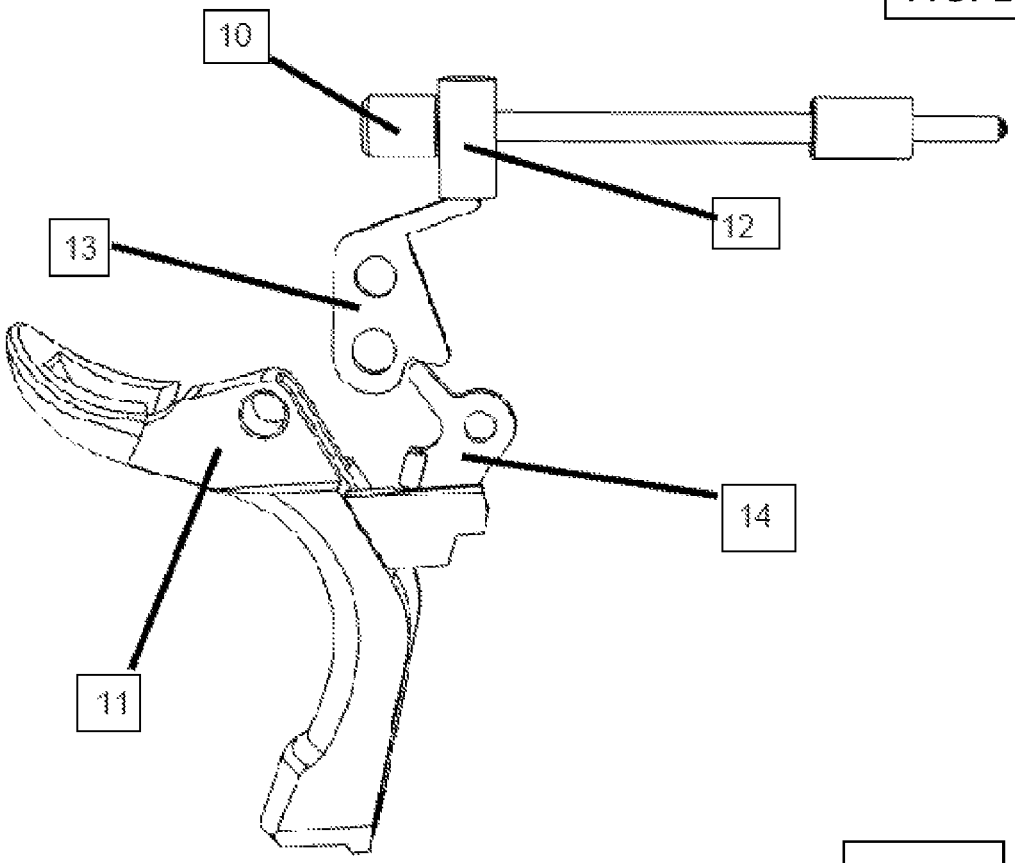
FIG. 1 is a side-view illustration of the internal firing pin safety mechanism. In this particular drawing, the safety is engaged.

FIG. 1 is a side view of the internal safety apparatus. The entire mechanism consists of five main components. When the user grips the firearm in a natural fashion, the beaver tail (11) will be pushed inwards. This movement will activate the beaver tail lever (14) by imparting a torque on to it, causing it to rotate in a clockwise (from the point of view of FIG. 1) fashion. As a result, the beaver tail lever (14) will connect with the plunger lever (13) and impart a torque on to it. This will cause the plunger lever (13) to rotate in a manner opposite to that of the trigger bar lever (counter-clockwise from the point of view of FIG. 1). The angular momentum of the plunger lever (13) will cause it to make a connection with the firing pin block (12). The plunger lever (13) will impart a force directed in an upward fashion to the firing pin block (12). This will cause the firing pin block (12) to rise upwards, revealing an opening through which the firing pin (10) can pass through and strike the firearm's chamber. It can be obtained from FIG. 1 that the firing pin block (12) is in said upward position, and the internal safety mechanism is therefore disengaged and the firing pin (10) is allowed to strike the chamber.

Figure 2:
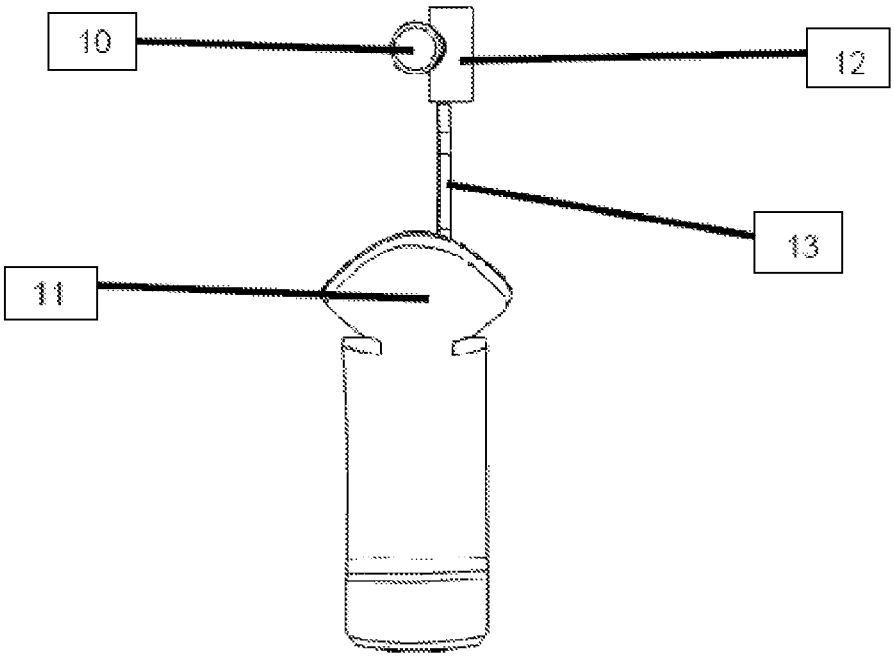
FIG. 2 is a rear-view illustration of the internal firing pin safety mechanism, in which the safety is engaged.
Figure 3:
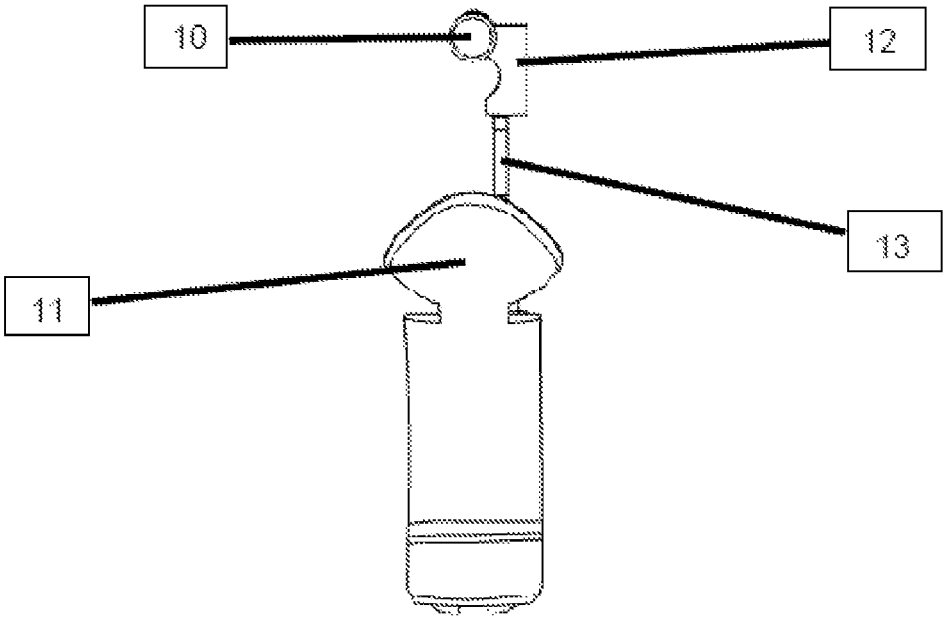
FIG. 3 is a rear-view illustration of the internal firing pin safety mechanism, in which the safety is disengaged.

FIGS. 2 & 3 are rear views of the internal safety mechanism when the safety is engaged and disengaged, respectively. In FIG. 2 the firing pin block (12) is in its downward position, and the firing pin (10) is therefore blocked from striking the chamber. In FIG. 3, however, the firing pin block (12) is in the upward position, having been acted upon by the plunger lever (13). This reveals a concave opening in the firing pin block (12) that is of a greater radius than the radius of the firing pin (10), through which the firing pin (10) is allowed to pass and thereby strike the chamber of the firearm.

Figure 4:
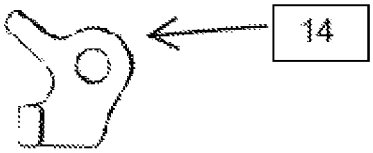
FIG. 4 is an illustration of the beaver tail lever.

FIG. 4 is an illustration of the beaver tail lever (14) in isolation. This part is what is acted upon by the beaver tail and in turn engages the plunger lever (13) from FIG. 1.

Figure 5:
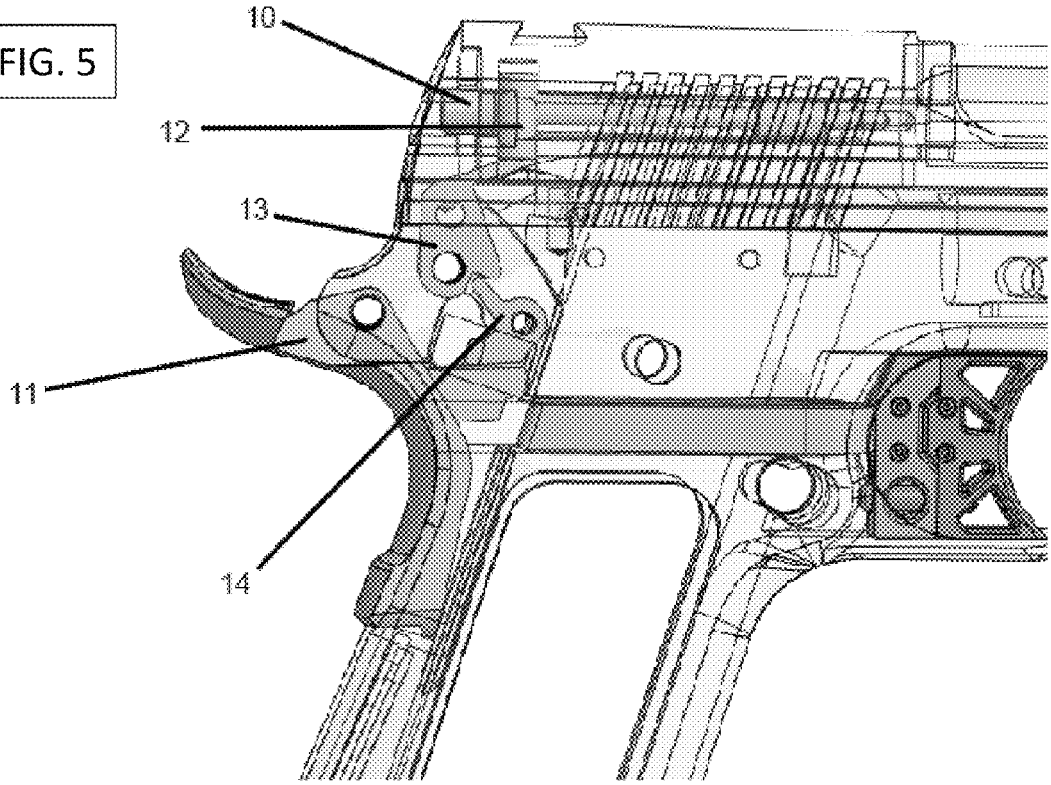
FIG. 5 is an illustration of the internal firing pin safety mechanism within the context of a pistol.

FIG. 5 is an illustration of the internal firing pin safety mechanism shown in the context of a pistol, for the purposes of clarification. Notice how the trigger bar is not attached to the beaver tail lever, hence it is not responsible for activating the internal firing pin safety mechanism.

The invention claimed is:

1. A firing pin safety apparatus for an M1911 80-Series pistol comprising a firing pin, a grip portion having an outwardly extended portion, a grip lever having an elongated protruding portion, and a plunger lever having a firing pin block and a notch to movably engage with the protruding portion of the grip lever, wherein in a locking position, an angular movement in a counterclockwise manner of the plunger lever triggers an upward movement of the firing pin block to engage with the firing pin and prevent an axial movement thereof.

2. The firing pin safety apparatus for an M1911 80-Series pistol of claim 1, wherein in an unlocking position, an angular movement in a clockwise manner of the plunger lever triggers a downward movement of the firing pin block to disengage with the firing pin and allow an axial movement thereof.

* * * * *